US008316911B2

(12) United States Patent
Cleaver

(10) Patent No.: US 8,316,911 B2
(45) Date of Patent: Nov. 27, 2012

(54) CHILD SAFETY LIFT CORD SYSTEM FOR WINDOW COVERINGS

(75) Inventor: Jay R. Cleaver, Lafayette, IN (US)

(73) Assignee: Lafayette Venetian Blind, Inc., West Lafayette, IN (US)

( * ) Notice: Subject to any disclaimer, the term of this patent is extended or adjusted under 35 U.S.C. 154(b) by 87 days.

(21) Appl. No.: 12/985,927

(22) Filed: Jan. 6, 2011

(65) Prior Publication Data

US 2012/0175068 A1 Jul. 12, 2012

(51) Int. Cl.
*A47H 5/032* (2006.01)

(52) U.S. Cl. ..... 160/84.01; 160/168.1 R

(58) Field of Classification Search ..... 160/84.01, 160/84.04, 84.05, 168.1 R, 173 R; 24/16 PB
See application file for complete search history.

(56) References Cited

U.S. PATENT DOCUMENTS

| | | | | |
|---|---|---|---|---|
| 2,310,014 | A * | 2/1943 | Apfel | 160/35 |
| 5,275,222 | A | 1/1994 | Jelic et al. | |
| 5,485,875 | A | 1/1996 | Genova | |
| 5,495,883 | A | 3/1996 | Jelic | |
| 5,553,650 | A | 9/1996 | Jelic | |
| 5,577,543 | A | 11/1996 | Jelic | |
| 5,613,540 | A | 3/1997 | Jelic | |
| 5,743,319 | A * | 4/1998 | Christopherson | 160/173 R |
| 5,894,876 | A * | 4/1999 | O'Brien | 160/84.01 |
| 5,906,233 | A | 5/1999 | May | |
| 6,119,314 | A * | 9/2000 | Freed | 24/16 PB |
| 6,453,974 | B1 | 9/2002 | Lai et al. | |
| 6,792,995 | B2 | 9/2004 | Judkins | |
| 6,860,312 | B2 | 3/2005 | Judkins | |
| 7,261,138 | B2 | 8/2007 | Judkins et al. | |
| 7,775,254 | B2 | 8/2010 | Judkins et al. | |
| 2005/0092448 | A1 * | 5/2005 | Lin | 160/291 |
| 2010/0126674 | A1 | 5/2010 | Lin | |
| 2011/0067819 | A1 * | 3/2011 | Huang | 160/84.01 |
| 2011/0186242 | A1 * | 8/2011 | Foley et al. | 160/193 |
| 2011/0203079 | A1 * | 8/2011 | Anthony et al. | 24/115 F |
| 2011/0209834 | A1 * | 9/2011 | Lowry et al. | 160/84.04 |

FOREIGN PATENT DOCUMENTS

| | | |
|---|---|---|
| EP | 2 221 443 A2 | 8/2010 |
| WO | WO2010/021841 | 2/2010 |

OTHER PUBLICATIONS

Window Covering Safety Standards—What Every Business Needs to Know, B&W Window Fashions, 2010.

2nd Provisional American National Standard for Safety of Corded Window Covering Products, ANSI/WCMA A100.1-2010 (PS2), Revision of Provisional ANSI/WCMA A100.1-2009, pp. 1-46. Child Safety at the Window by Hunter Douglas, website: www.hunterdouglas.com/starter-guide-advantage-child-safety.jsp, site visited Dec. 6, 2010.

Sure-Shade Encased Lift Cord Tape, website: www,rowleycompany.com/10_search.asp?goto=productsearch.asp, p. 1, sited visited Dec. 6, 2010.

UltraGlide—Hunter Douglas Window Treatments, website: www.hunterdouglas.com/product-option.jsp?id-35, pp. 1-2, site visited Dec. 6, 2010.

* cited by examiner

*Primary Examiner* — Blair M. Johnson
(74) *Attorney, Agent, or Firm* — Woodard Emhardt Moriarty McNett & Henry, LLP

(57) ABSTRACT

A lift cord safety system for use with a Roman shade type window covering having a head rail, a bottom rail and a shade movable between a raised and a lowered position. At least one lift cord vertically extends down from the head rail toward the bottom rail. A flexible sleeve is associated with and substantially surrounds each lift cord. A set of vertically spaced guides are also associated with each lift cord and are attached to the shade. The sleeve and the lift cord are disposed within each guide of the associated set of vertically spaced guides. A zip tie affixes the sleeve to each guide of the associated set of vertically spaced guides.

9 Claims, 11 Drawing Sheets

CHILD SAFETY LIFT CORD SYSTEM FOR WINDOW COVERINGS

BACKGROUND

The present invention generally relates to child safety lift cord systems for use with retractable window coverings and, in particular, to Roman shade window coverings of the type having lift cords that are run through guides attached to the shade material at vertically spaced intervals along the shade.

Homeowners and businesses alike have increasingly used retractable window coverings for a variety of aesthetic and functional purposes. Retractable window coverings include a control mechanism which allows a user to raise or lower the window covering based on the user's preference. In the Roman shade type window coverings, lift cords running along the shade extend and retract in order to move the window covering between its lowered and raised positions. The lift cords vertically extend from the top of the window covering and connect to a bottom portion of the covering, such as a bottom rail or other retaining structure. These lift cords should not be confused with the free hanging pull cords, sometimes also referred to as "lift cords," that are manipulated by a user to control the raising and lowering of the shade. Such pull cords pose a separate safety hazard for children which is not addressed by the present disclosure.

Though necessary for proper operation of a retractable window covering, lift cords pose a considerable and serious risk to infants and children. Even though these lift cords are often positioned along the rear unexposed side of the shade, they can still be inadvertently pulled by a child thereby causing an unsafe loop. Unfortunately, these loops may become large enough to be wrapped around a child or infant's head or other body part. Due to the weight of the bottom rail and the shade material, gravity forces these loops to be pulled tight thereby creating a constricting force around the child's neck or other body part. In such an unfortunate event, the loop can potentially cause significant injury or even death.

Prior systems attempting to address problems associated with window covering lift cords have been inadequate. Some prior art systems utilize unsatisfactory crimping, gluing and snap-type connection techniques that use open C-clips to attach the lift cord to the shade. Other designs leave the lift cord exposed, thereby maintaining the risk that a child or infant may directly pull the lift cord and form an unsafe loop.

Thus, there is a need for improvement in this field.

SUMMARY

The present invention provides an improved lift cord system for window coverings. The claims, and only the claims, define the invention.

A lift cord safety system is provided for use with a Roman shade type window covering having a head rail, a bottom rail and a shade movable between a raised and a lowered position. A plurality of lift cords vertically extend down from the head rail toward the bottom rail. A flexible sleeve is associated with and substantially surrounds each lift cord at least up to a height within about one foot from the head rail. A set of vertically spaced guides are also associated with each lift cord and are attached to the shade. The sleeve and the lift cord are disposed within each guide of the associated set of vertically spaced guides. A zip tie securely and physically affixes the sleeve to each guide of the associated set of vertically spaced guides.

It is an object of certain embodiments of the present disclosure is to provide an improved lift cord system for window coverings.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
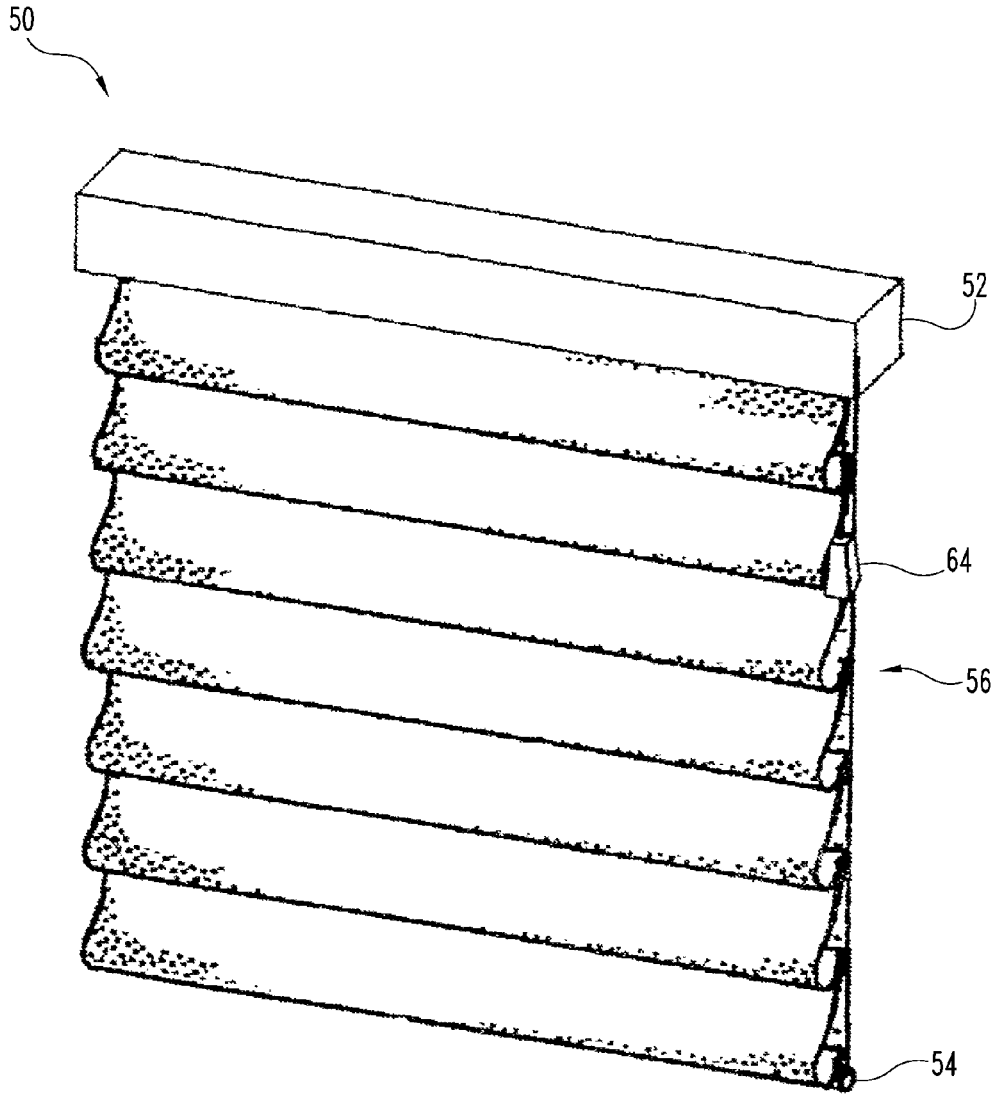
Fig. 1 (PRIOR ART)
FIG. 1 is a front perspective view of a conventional window covering.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Except as specifically defined herein, the words/terms used in the claims is to only have its plain and ordinary meaning. Such plain and ordinary meaning is inclusive of all consistent dictionary definitions from the most recently published Webster's dictionaries and Random House dictionaries.

As used in the claims and the specification, the following words/terms have the following definitions:

The term "pull cord" refers to a free hanging length of string, rope, cord or chain manipulated by a user to control the raising and lowering of a window covering. The pull cord may have a looped or unlooped design. Because pull cords pose a hazardous risks to children or infants, a variety of safety features are associated with pull cords, such as wall mounts. However, such safety features are not relevant to the present invention and are not described herein.

The term "lift cord" refers to the length of string, rope, cord or chain which extends vertically down from the head rail in the direction of the bottom rail. The lift cord is connected on its upper end to a control system (e.g., spool or shaft operated) typically concealed by the head rail. While in use, it is the control system which directly retracts or extends the lift cord in order to raise or lower the window covering.

The term "zip tie" refers to a closed loop type fastening device which may be either releaseable or non-releasable, reusable or non-reusable, and is inclusive of devices also known in the art as tie-wraps or cable ties.

Figure 2:
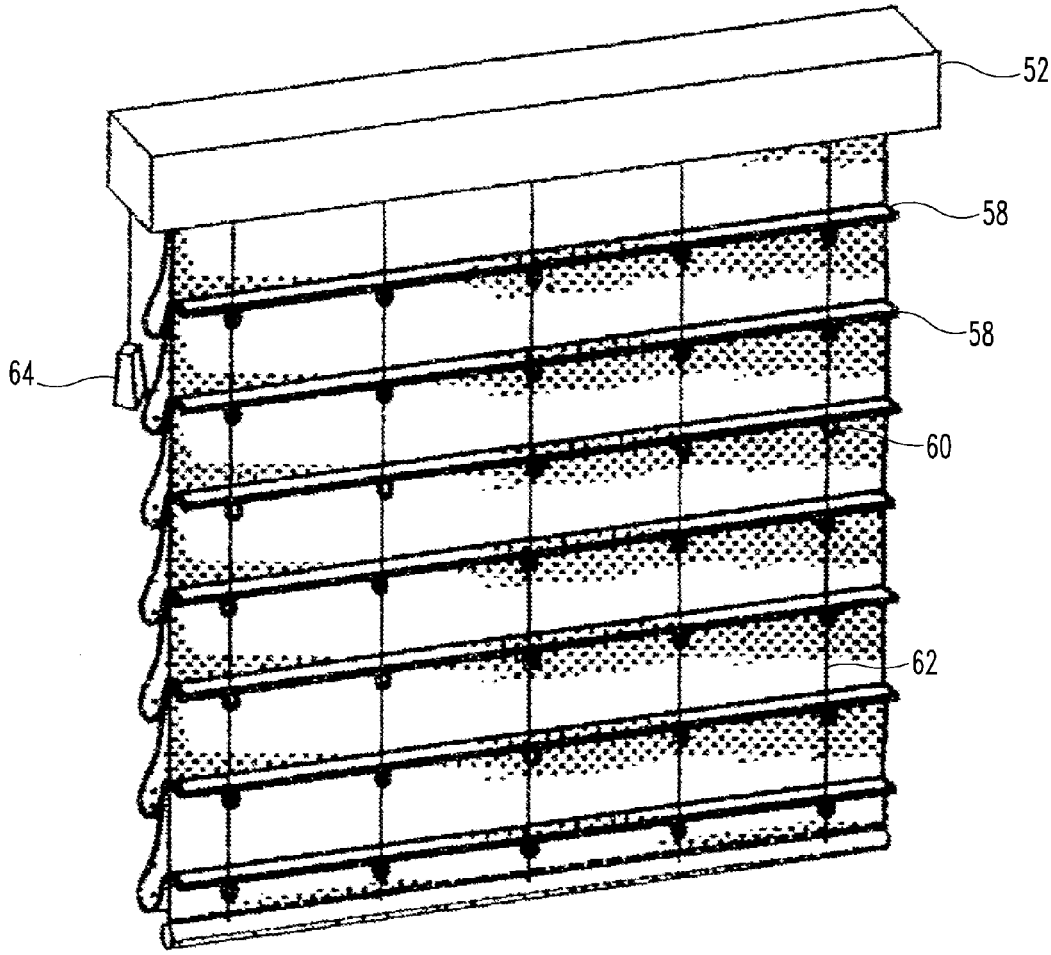
Fig. 2 (PRIOR ART)
FIG. 2 is a rear perspective view of a conventional window covering.
Figure 3:
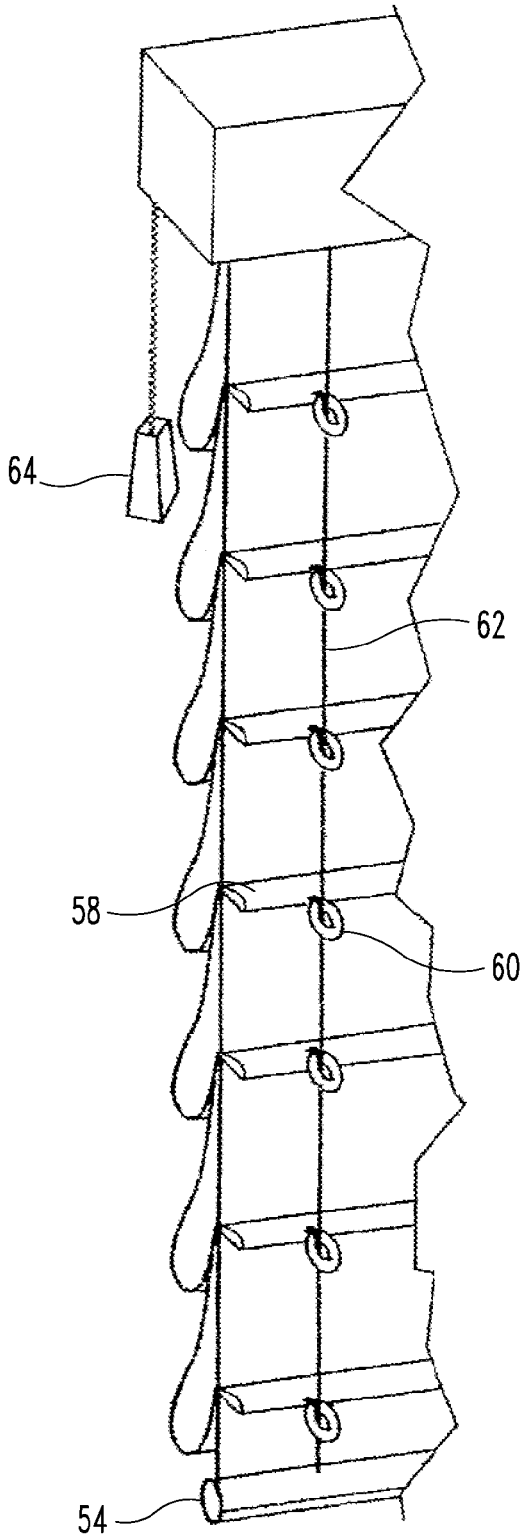
Fig. 3 (PRIOR ART)
FIG. 3 is an enlarged fragmentary view of one edge of the conventional window covering depicted in FIG. 2.

In order to provide the proper context for the embodiments of the present disclosure, known window coverings and prior art lift cord safety systems will be initially presented and discussed. One common type of window covering is the Roman shade and an example of one is depicted in FIGS. 1-3. As is well known in the prior art, these types of window coverings 50 typically include a head rail 52, a bottom rail (or hem) 54, and a shade material 56 which is connected to and extends between head rail 52 and bottom rail 54. A control system for operating the window covering 50 is concealed by head rail 52. Such control systems are well known by those skilled in the relevant art and are not described here.

As viewed best in FIGS. 2-3, a series of horizontally extending pleats 58 are provided on the back side of shade material 56. A plurality of rings 60 are in turn attached to pleats 58. As illustrated, each set of vertically oriented and spaced rings 60 corresponds to a lift cord 62. The vertical arrangement of each set of guide rings 60 creates a vertical passageway for its associated lift cord 62 to freely pass through. Each lift cord 62 is connected on its upper end to the control system, which is again concealed by head rail 52, and to bottom rail 54 on its lower end. Through the manipulation of a pull cord 64, the lift cords 62 work in combination with the control system to raise and lower the window covering 50 in a known and conventional manner.

Figure 4:
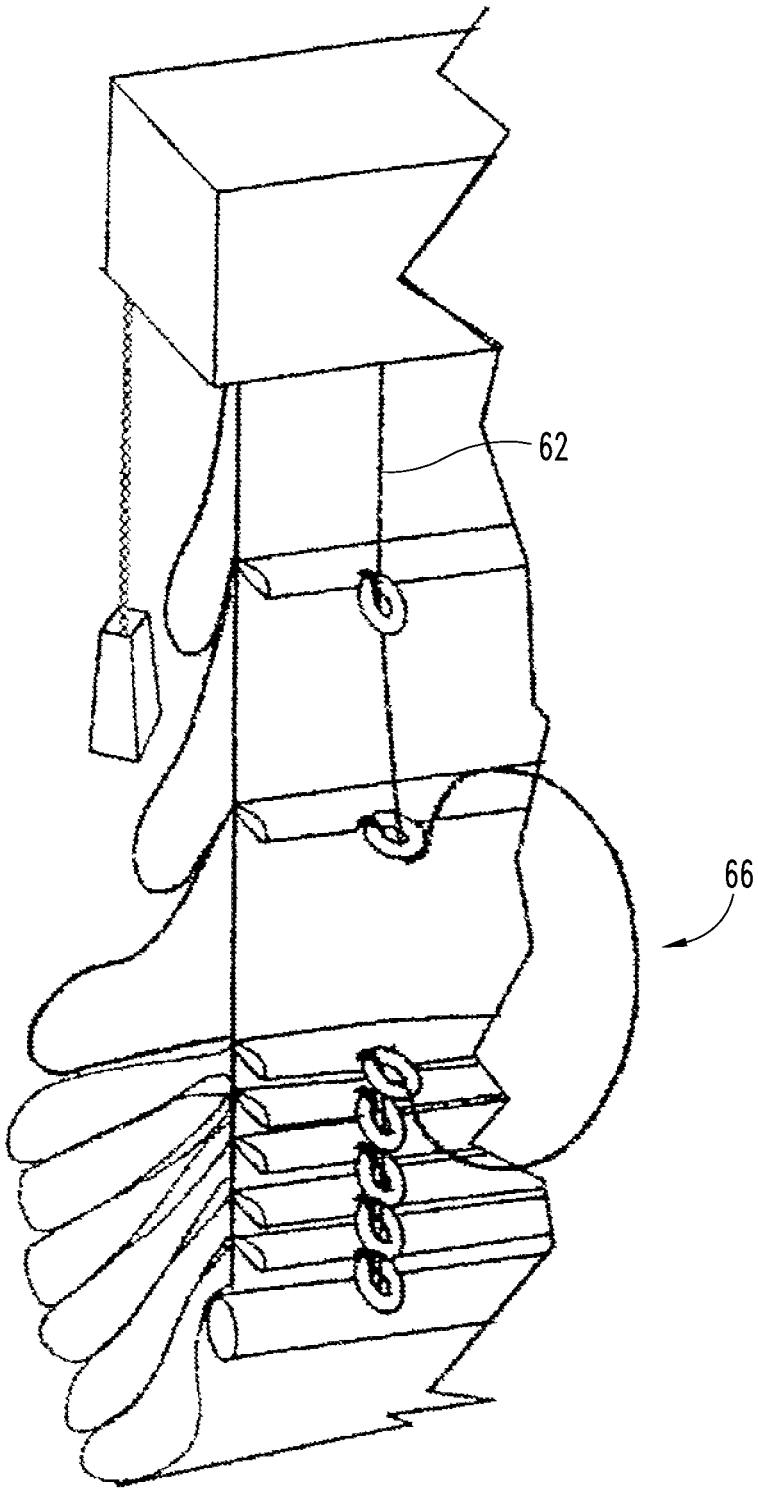
Fig. 4 (PRIOR ART)
FIG. 4 is an enlarged fragmentary view of one edge of a conventional window covering illustrating a loop formed in the lift cord which poses a significant risk to a child or infant.

FIG. 4 depicts an unsafe situation which is avoided through incorporation of the embodiments of the present application. As illustrated, a relatively large loop 66 can be created if lift cord 62 is pulled in a direction away from shade material 56. When the lift cord 62 is pulled in this manner, the bottom rail 54 is forced upward and the excess lift cord 62 creates unsafe loop 66. Loop 66 may easily become large enough to wrap around the head or other body part of an infant or child. The window covering industry has recognized this hazardous situation and has begun to design systems intended to restrict lift cords from being pulled in this manner. Present standards require that the lift cord loop be limited in circumference to no more than 16.6 inches (+ or −0.3 inches).

Figure 5:
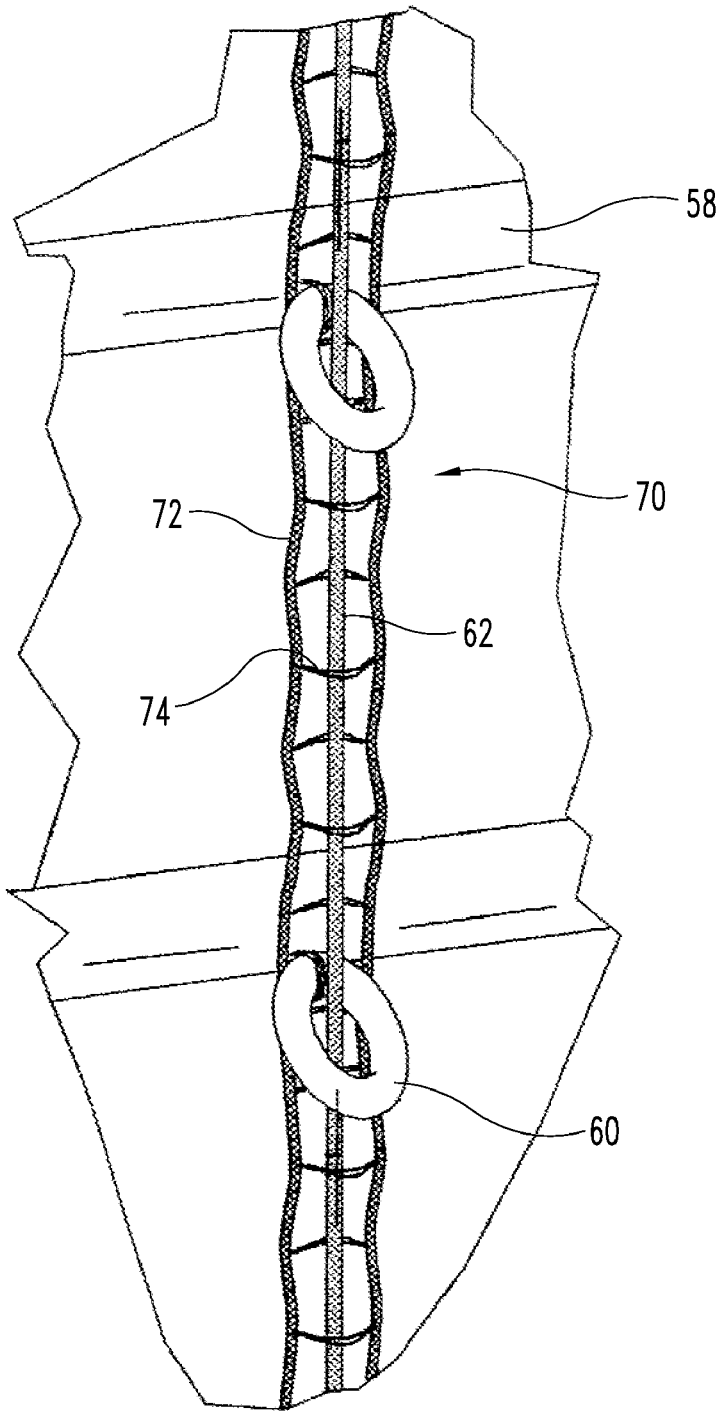
Fig. 5 (PRIOR ART)
FIG. 5 is an enlarged fragmentary view of a known lift cord safety system.
Figure 6:
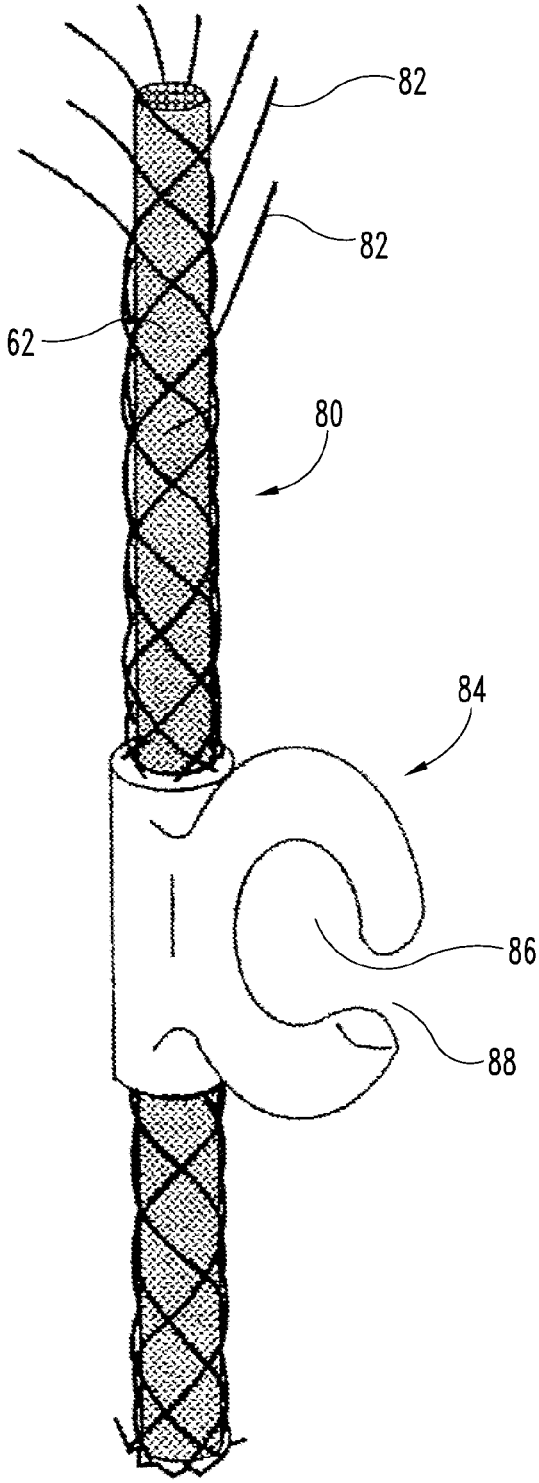
Fig. 6 (PRIOR ART)
FIG. 6 is an enlarged fragmentary view of a known lift cord safety shroud.
Figure 7:
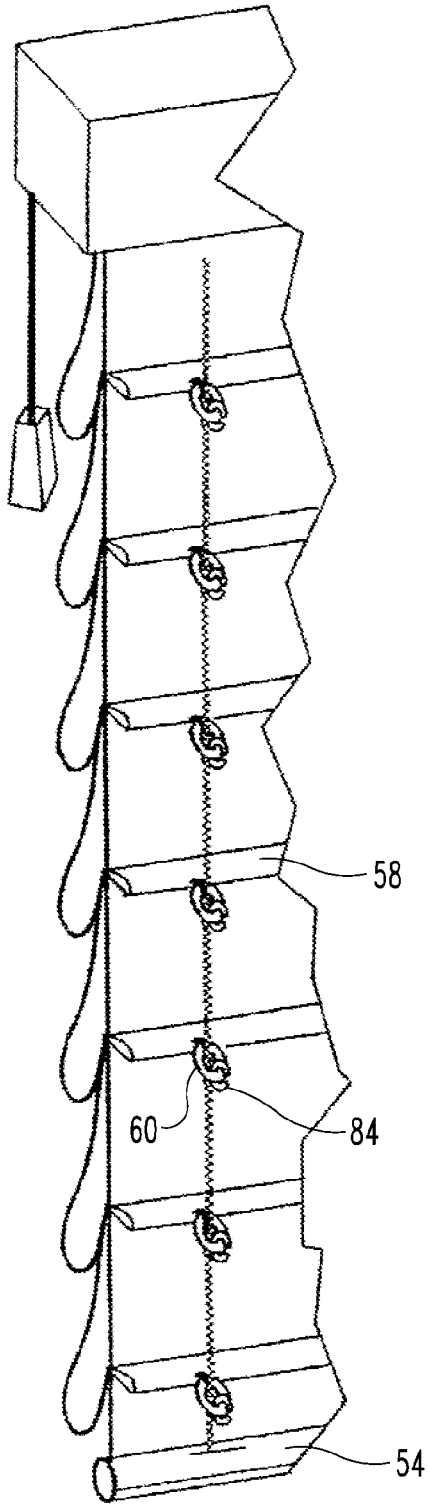
Fig. 7 (PRIOR ART)
FIG. 7 is an enlarged fragmentary view of one edge of a window covering utilizing the safety shroud depicted in FIG. 6
Figure 8:
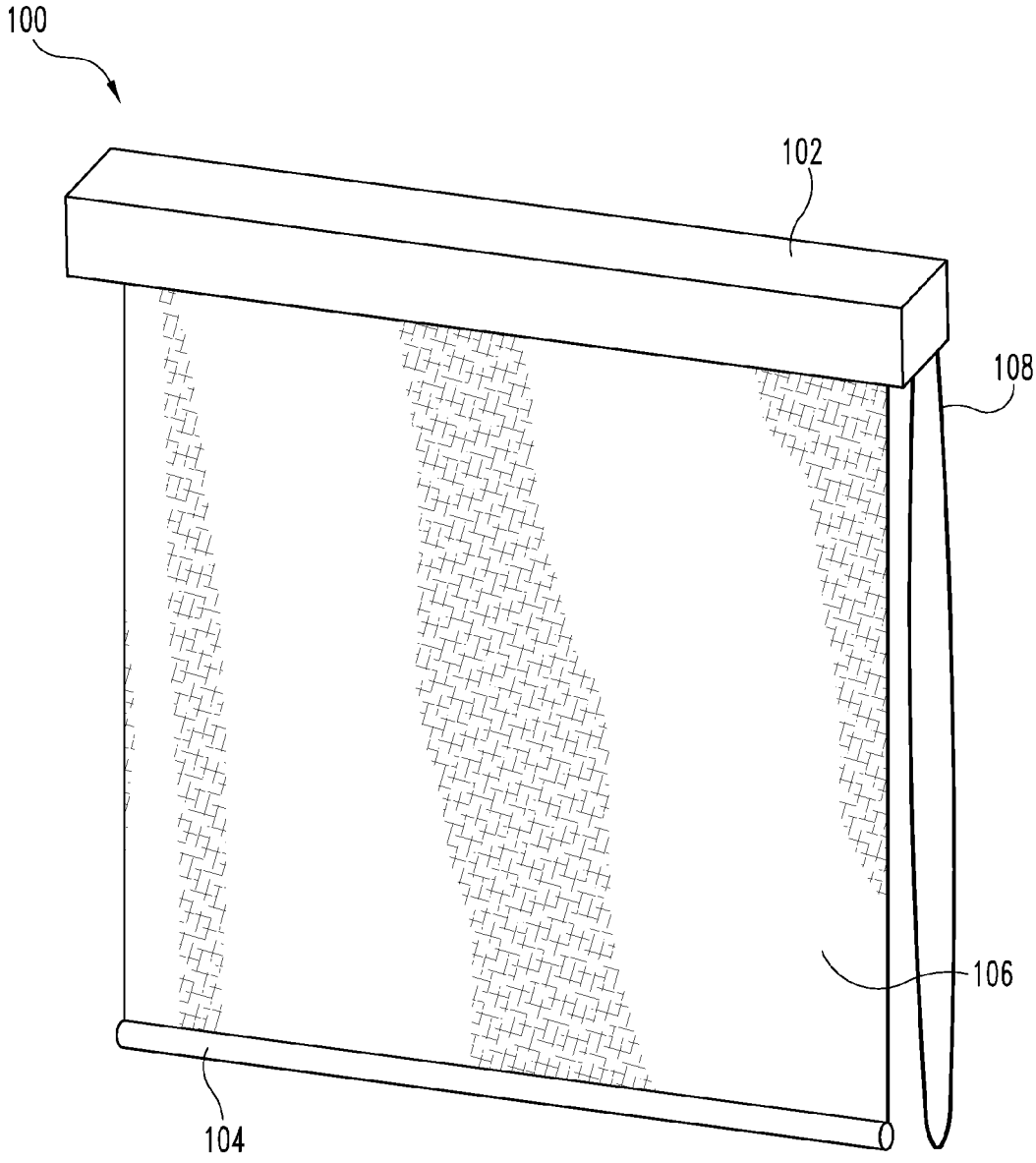
FIG. 8 is a front perspective view of a window covering utilizing a lift cord safety system according to one embodiment of the present disclosure.

FIGS. 5-7 present two known lift cord safety systems for use with typical retractable window coverings, such as the one previously discussed. These configurations are discussed and depicted in International Publication Number WO 2010/021841 A1, International Application Number PCT/US2009/052802, which published on Feb. 25, 2010 to Anthony et al. (referred to hereafter as the Anthony reference). In the embodiment depicted in FIG. 5, a protector 70 is associated with each lift cord 62. In essence, the protector 70 is a miniaturized cord ladder. As illustrated, the protector 70 includes a pair of vertically extending side runs 72 which are interconnected by horizontal rungs 74. The protector 70 extends from a connection in the head rail of the window covering to a connection to the bottom rail.

As taught by the Anthony reference, the lift cord 62 is woven in and out of the horizontal rungs 74. Ideally, the protector 70 would be gripped by a child or infant instead of the lift cord 62, in which case the attachment of the protector 70 at each pleat 58 would limit the size of any loop created. Unfortunately, the protector 70 leaves the lift cord 62 partially exposed. A young child with small fingers can grab and pull the lift cord 62 directly, thereby creating the same large loop the protector 70 sought to be avoided. As a result, the purpose of protector 70 is undermined and the addition of the protector is rendered useless.

A further lift cord safety system proposed by the Anthony reference is depicted in FIGS. 6-7. In this embodiment, a protector 80 is provided around lift cord 62. Protector 80 is a spirally woven open sheath composed of a plurality of fibers 82 which surrounds lift cord 62 while still leaving it partially exposed. Positioned at set positions along protector 80 are a plurality of C-clips 84. Each C-clip 84 is configured to releasably engage a guide ring 60. In use, the lift cord 62 is guided through the protector 80, both of which are then threaded through a vertical set of guide rings 60. Finally, each C-clip 84 is snapped over its respective guide ring 84. This Anthony embodiment is intended to prevent dangerous loops from being formed due to the arrangement of the fibers 82 making up protector 80 and the spacing defined by adjacent C-clips 84. However, this system also has its disadvantages.

Each C-clip 84 has a circular passage 86 having a diameter slightly larger than the cross-section of guide ring 60, as well as an open neck entry 88 having a dimension slightly smaller than the cross-section of a guide ring 60. The open neck entry 88 allows the C-clip 84 to be forced over a guide ring 60 and resiliently held in place. Unfortunately, children attempting to handle and play with the low hanging C-clips 84 may inadvertently release the C-clip 84 from the guide ring 60. Though adjacent C-clips 84 may still be in place, a large loop can still be produced, posing a serious threat to the child or infant.

The method of manufacturing this embodiment is also problematic. While reducing the risk of injury, lift cord safety systems should also be economical to manufacture. As taught by the Anthony reference, the preferred way of securing the C-clips 84 to protector 80 is by injection molding a resilient plastic around protector 80 while maintaining a hollow core such that the lift cord 62 can still pass in an unobstructed fashion through C-clip 84. As is readily apparent to those skilled in the relevant art, manufacturing the C-clips 84 is such a manner would not only be difficult, but also quite expensive. The alternative method presented in the Anthony reference, i.e., gluing and crimping, present their own problems.

Referring now to FIGS. 8-11, one embodiment of a lift cord safety system is provided which is designed to prevent the creation of a hazardous loop, like the one depicted in FIG. 4. The embodiments of the present application can be applied equally to a variety of known types of window coverings. In the depicted embodiment, the window covering 100 includes a head rail 102, a bottom rail 104, and a shade material 106 which is connected to and extends between head rail 102 and bottom rail 104. The shade material 106 can be composed of a variety of known materials, such as, but not limited to, fabrics, plastics, metals, or natural fibers (e.g., bamboo). A control system for operating the window covering 100 is concealed by head rail 102. The control system dictates the movement of the shade material 106 from a fully raised, a fully lowered, or any position there between. Such control systems are well known by those skilled in the relevant art and are not described here.

Figure 9:
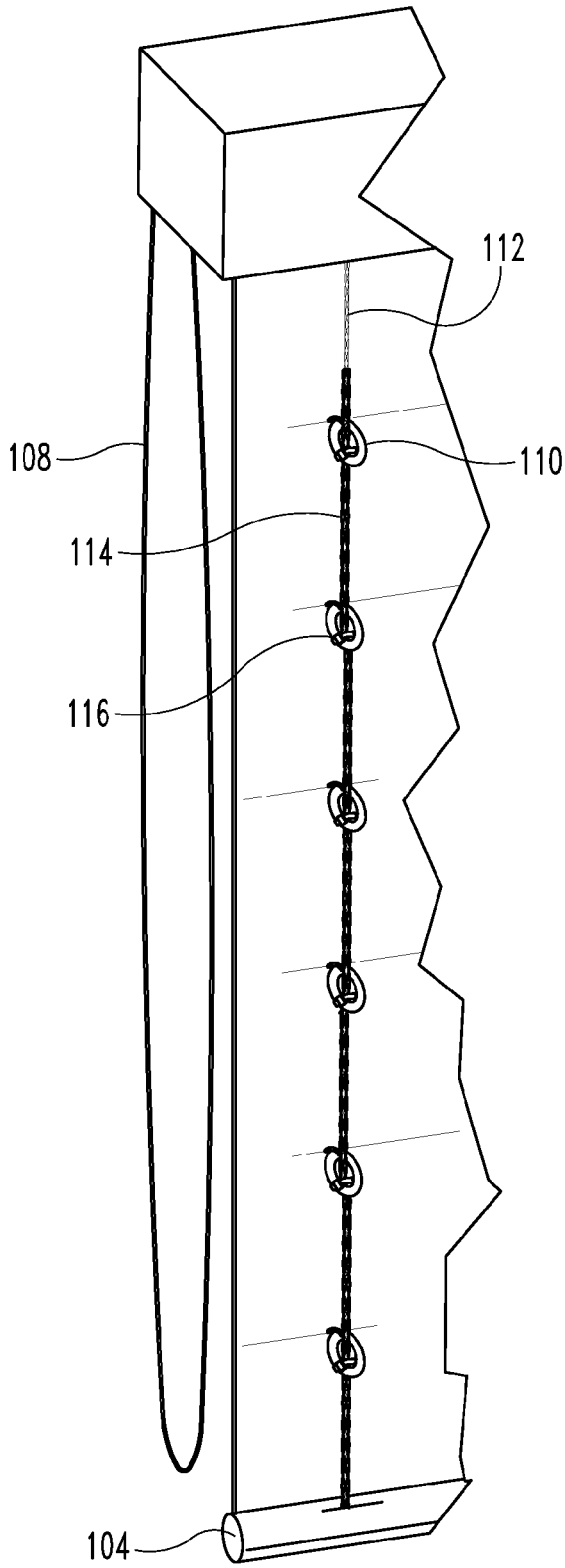
FIG. 9 is an enlarged fragmentary view of one rear edge of a window covering in its lowered position utilizing a lift cord safety system according to one embodiment of the present disclosure.
Figure 10:
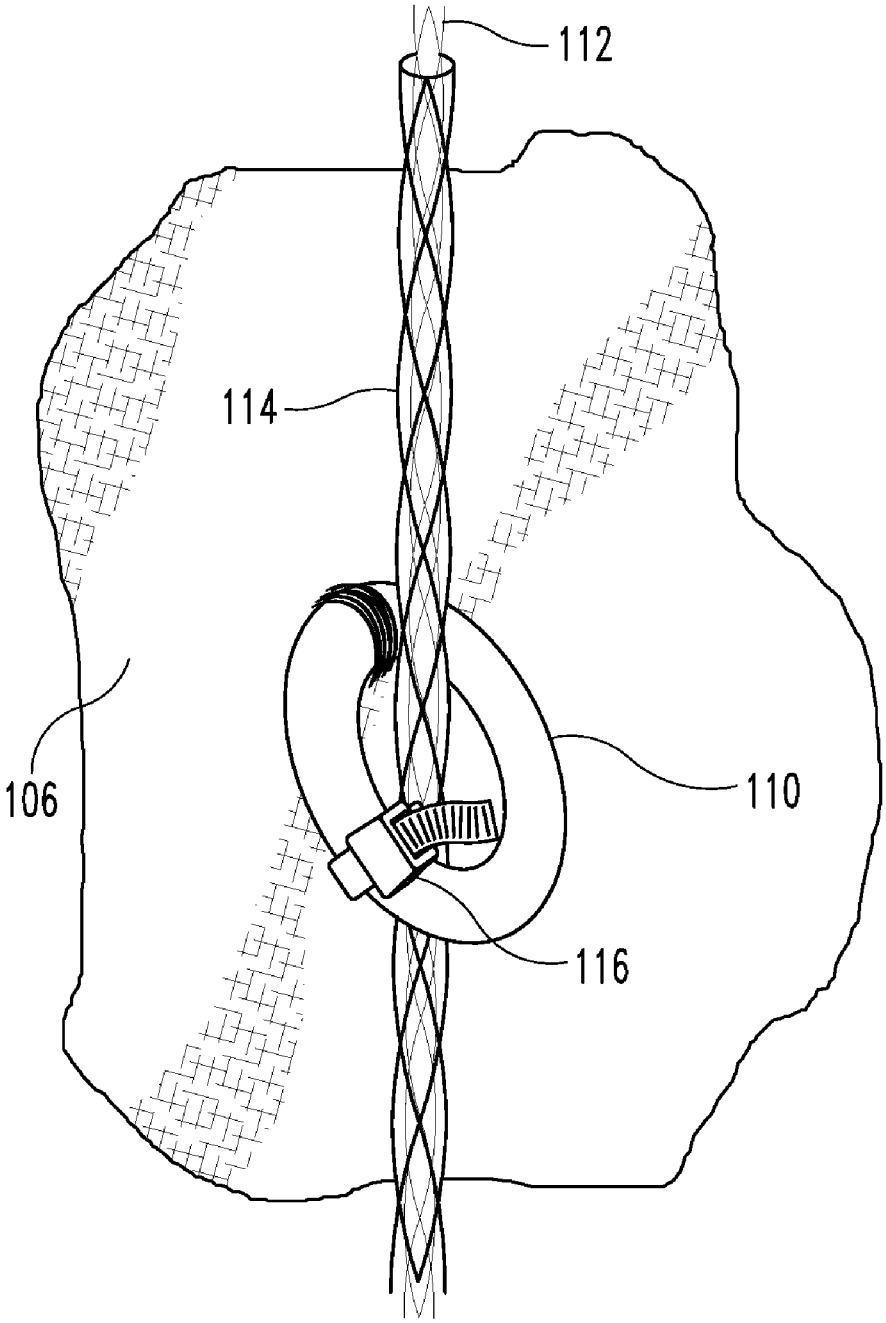
FIG. 10 is an expanded fragmentary view of a lift cord sleeve and securement arrangement according to one embodiment of the present disclosure.

As viewed best in FIGS. 9-10, a plurality of guides 110 are directly attached to shade material 106. In the illustrated embodiment, guides 110 are rings having a substantially circular shape, though a variety of geometric shapes may be used, such as, but not limited to, triangular, square, diamond or rectangular. Though only one set of vertically spaced guides 110 are illustrated, more than one set may be provided on shade material 106. In one embodiment, the guides 110 are vertically spaced no more than eight inches apart. In another embodiment, the guides 110 are vertically spaced no more than seven inches apart. As appreciated by those skilled in the art, the guides 110 may be attached to other structures or at other locations common with window covering designs, such as slats or on pleats similar to those depicted in FIGS. 2-3.

Pursuant to the embodiments of the present application, each set of vertically spaced guides 110 corresponds to a lift cord 112 and its associated protective sleeve 114. Each lift cord 112 is connected on its upper end to the control system, which is concealed by head rail 102. In the illustrated embodiment, the lift cord 112 is connected to bottom rail 104 on its lower end. In another non-illustrated embodiment, the lift cord 112 is attached to the guide 110 nearest to bottom rail 104.

The protective sleeve 114 is composed of spirally wound fibers, such as, but not limited to, nylon. Protective sleeves manufactured by Julius Koch USA have been found to be acceptable. The fibers of the protective sleeve 114 are woven such that the lift cord 112 is not accessible through the sleeve 114. In order to allow the lift cord 112 to freely move within the protective sleeve 114, the protective sleeve 114 has a diameter larger than that of the lift cord 112.

The vertical arrangement of each set of guides 110 creates a vertical passageway for the associated lift cord 112 and protective sleeve 114 to be threaded through and disposed within the guides 110. The protective sleeve 114 is securely attached to each guide 110 of each vertical set. In the illustrated embodiment, the protective sleeve 114 is, secured to the guide 110 by a zip tie 116. Though only zip tie fasteners are depicted, it is contemplated that the protective sleeve 114 may be glued, sewn, or otherwise securely attached to each guide 110 through a variety of securement means. In the preferred embodiment, zip tie 116 is of the non-releasable type having no freely accessible releasing mechanism. In other contemplated embodiments, releasable or reusable zip ties may be used.

As clearly depicted in FIG. 10, zip tie 116 is threaded through the protective sleeve 114 and secured around each guide 110. By securing the protective sleeve 114 to the guide 110 in this fashion, the protective sleeve 114 maintains its proper position despite the handling of a child or infant. As appreciated by those skilled in the art, the protective sleeve 114 is held in place unless the zip tie 116 is cut or a tool is used to release its ratcheted grip.

Figure 11:
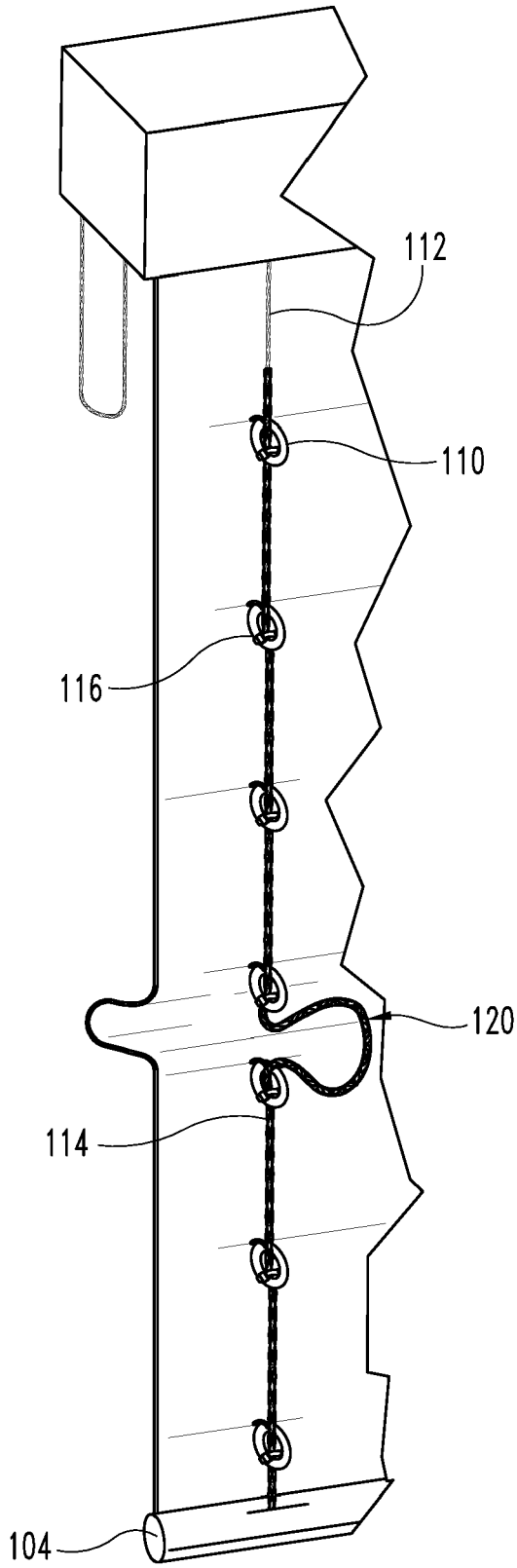
FIG. 11 is an enlarged fragmentary view of one rear edge of a window covering utilizing a lift cord safety system according to one embodiment of the present disclosure and demonstrating the relatively small loop formed in the event the lift cord is inadvertently pulled outward.

FIG. 11 illustrates the situation in which the lift cord 112 is pulled away from the shade material 106 in an attempt to form a loop 120. Because the protective sleeve 114 is constructed such that the lift cord 112 is not directly accessible, any attempt to pull the lift cord 112 will require that the protective sleeve 114 be pulled as well. As described above, the protective sleeve 114 is secured to each guide 110 at fixed lengths. These fixed lengths are small enough that any loop 120 formed is not large enough to pose a significant risk to a child or infant. In one embodiment, the loop defined by the protective sleeve and shade material between adjacent guides is less than 16.6 inches.

In the depicted embodiment, the protective sleeve 114 may not surround the portion of the lift cord 112 adjacent to the head rail 102. In one embodiment, the protective sleeve 114 is provided around the lift cord 112 beginning at a position twelve inches below head rail 102. In another embodiment, the protective sleeve 114 may surround the entire length of the lift cord 112.

The lift cord safety systems disclosed in the present disclosure are cost-effective to a window covering manufacturer. Unlike prior designs, the safety systems according to certain embodiments of the present disclosure do not require complex and expensive components. Pursuant to the illustrated embodiment, the zip ties 116 may be easily threaded through the protective sleeve 114 either by hand or through an automated machine process. Because zip ties 116 are relatively inexpensive to purchase, this embodiment of the present disclosure provides an economic lift cord safety system.

While the invention has, been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. A Roman shade type window covering having a child safe lift cord system comprising:

a head rail;

a bottom rail;

a shade movable between a raised position and a lowered position, the window covering material having an upper portion adjacent to the head rail and a lower portion adjacent to the bottom rail;

a plurality of lift cords to raise and lower the window covering material, the lift cords vertically extend down from the head rail toward the bottom rail;

a flexible sleeve composed of spirally woven fibers associated with each lift cord, the flexible sleeve substantially surrounds its associated lift cord;

a set of vertically spaced guides associated with each lift cord, the guides are attached to the shade, the sleeve and the lift cord are disposed within each guide of the associated set of vertically spaced guides, each guide is sized to permit the lift cord to freely pass through; and a plurality of zip ties threaded through the sleeve and affixed to each guide of the associated set of vertically spaced guides.

2. The Roman shade type window covering of claim 1, wherein the lift cord is connected to the bottom rail.

3. The Roman shade type window covering of claim 1, wherein the lift cord is connected to the guide nearest the bottom rail.

4. The Roman shade type window covering of claim 1, wherein the sleeve surrounds the entire length of the lift cord between the guides such that the lift cord is not accessible through the sleeve.

5. The Roman shade type window covering of claim 1, wherein the sleeve is provided around the lift cord at a position 12 inches below the head rail and extends downward toward the bottom rail.

6. The Roman shade type window covering of claim 1, wherein the sleeve is made of nylon.

7. The Roman shade type window covering of claim 1, wherein the guides are sewn to the shade.

8. The Roman shade type window covering of claim 1, wherein two adjacent guides are spaced less than 7 inches apart.

9. The Roman shade type window covering of claim 1, wherein the zip tie is of the non-releasable type.

* * * * *